US006557184B2

(12) United States Patent
Gafforio

(10) Patent No.: US 6,557,184 B2
(45) Date of Patent: May 6, 2003

(54) DEVICE FOR HOOKING THE VISOR OF A HELMET FOR MOTORCYCLES

(75) Inventor: Luca Gafforio, Comun Nuovo BG (IT)

(73) Assignee: Opticos, S.r.l., Brembate di Sopra (IT)

( * ) Notice: Subject to any disclaimer, the term of this patent is extended or adjusted under 35 U.S.C. 154(b) by 0 days.

(21) Appl. No.: 09/951,269

(22) Filed: Sep. 13, 2001

(65) Prior Publication Data

US 2002/0062517 A1 May 30, 2002

Related U.S. Application Data

(63) Continuation-in-part of application No. 09/416,854, filed on Oct. 12, 1999, now abandoned.

(30) Foreign Application Priority Data

May 27, 1999 (EP) ..... 99830325

(51) Int. Cl.[7] ..... A42B 1/08
(52) U.S. Cl. ..... 2/424
(58) Field of Search ..... 2/424, 410, 10, 2/6.3, 6.5

(56) References Cited

U.S. PATENT DOCUMENTS 4,124,902 A 11/1978 Seres et al.
4,242,757 A * 1/1981 Nava ..... 2/10
4,247,960 A * 2/1981 Nava ..... 2/424
4,297,747 A * 11/1981 Nava ..... 2/424
4,495,657 A 1/1985 Bay
4,615,052 A * 10/1986 Nava ..... 2/424
5,365,615 A 11/1994 Piszkin
5,444,875 A * 8/1995 Taniuchi ..... 2/424
6,253,386 B1 * 7/2001 Gafforio ..... 2/424

FOREIGN PATENT DOCUMENTS

FR 2 246 232 5/1975
WO WO 95/20886 8/1995

* cited by examiner

*Primary Examiner*—Rodney M. Lindsey
(74) *Attorney, Agent, or Firm*—Collard & Roe, P.C.

(57) ABSTRACT

A device for hooking a visor of a helmet for motorcyclists to a mechanism for moving a visor, preferably embedded in a cap. There is also a device for extracting the visor from the embedding and a device to support the visor having the shape of an arched support or table. This device comprises a visor having guides adjustably engaged in a series of flanks of a table wherein there is a hole or opening for a hooking element which is adjustable within an eyelet disposed on the table. There is also a slide integral in the table having an eyelet wherein a bush translates, which is coaxially anchored to a hooking block and a sheet like spring anchored to a side and in touch with the bush to put a pressure on the bush. This pressure keeps the bush in contact with the block within the opening of the visor.

4 Claims, 6 Drawing Sheets

DEVICE FOR HOOKING THE VISOR OF A HELMET FOR MOTORCYCLES

CROSS REFERENCE TO THE RELATED ART

This application is a continuation in part application of U.S. patent application Ser. No. 09/416,854 filed on Oct. 12, 1999 now abandoned wherein priority is claimed under 35 U.S.C. 120 which is based upon European Patent Application Serial No. 998 303 25.9 filed on May 27, 1999 wherein priority is claimed under 35 U.S.C. 119.

BACKGROUND OF THE INVENTION

1. Field of the Invention

The present invention relates to a device for hooking a visor in an adjustable position. This visor can be used with motorcycle helmets and the like, wherein there is a special activating mechanism that maintains the visor, when it is in closed position. This activating mechanism is entirely embedded in the helmet and flush with the external surface of the helmet, to avoid discontinuities on the external surface of the helmet.

2. Description of the Prior Art

Presently known visors for motorcycle safety helmets for motorcyclists such as "integral" helmets, are anchored on both sides of the helmet cap by means of pins integral with the cap and protruding therefrom forming a hooking system. This hooking system has the drawback of having the visor cantilevering on the cap, both when it is in closed position on the porthole-aperture and when it is lifted, i.e. in open position.

In practice, these cap-hooking systems involve some drawbacks, namely a discontinuity in the external surface of the cap, which involves alterations in the aerodynamic characteristics of the helmet, and also poor aesthetic characteristics.

In addition, the known hooking systems require the disassembly of the visor in those cases when it is necessary to adjust its position with respect to the porthole-aperture, for instance, when it is necessary to replace the usual gasket around the porthole-aperture because of wear or accidental breakdown.

These known hooking systems require the use of tools of various kind for the assembly and the disassembly of the visor from the opening mechanisms of the same.

In other cases, the disassembly of the visor is made without using tools. However, to carry out the operation, it is necessary to take off from the helmet some additional components (side plates or lids), snap mounted on the helmet cap. These components create discontinuities on the cap's external surface, which cover the side ends of the visor, under which there is the hooking of the visor to the opening mechanisms.

SUMMARY OF THE INVENTION

To obviate these drawbacks and disadvantages, a mechanical device has been proposed which is able to have the visor fully embedded in and flush with the helmet cap, to eliminate the surface discontinuities of the cap and to improve its aesthetic as well as its aerodynamic characteristics.

This device also includes information relating to U.S. Pat. No. 6,253,386 incorporated herein by reference. This device begins from a closed visor starting position with a closed visor embedded in the cap. This mechanism comprises means for unlocking the visor from its closed position embedded in the cap, and for imparting in the visor a movement of side extraction and simultaneous advancing of the visor, until this comes out from the embedding. This movement allows the visor to rotate upwards until a complete opening is achieved, possibly through various intermediate step positions. Afterwards the visor is brought back by hand to a closed position, with the automatic recovery of the same in the position embedded in the cap.

In this particular case, the visor is hooked to an arched support referred to as a "table", which in the above mentioned patent automatically shifts outside the porthole-aperture of the helmet, to allow the visor to rotate upwards.

From what has been expounded hereinabove, it is easy to understand that if the visor is hooked to the table in a stable manner, its possible replacement, for any reason whatever, involves the use of tools and long times for the correct repositioning of the visor. Therefore, an object of the present invention is to realize, by using the presence of the table making part of the above described visor movement mechanism, a visor hooking device that hooks the visor without the help of special tools or qualified personnel.

Another object of the invention is to realize a visor hooking device that allows the adjustment of the visor position with regard to the table (or like support) in a quick, safe manner and without removing the visor from the helmet.

A further object of the invention is to create a visor hooking device so designed and structured as to ensure a correct coupling of the visor against the usual gasket of the porthole-aperture, and therefore the sealing of the visor in its closed position.

These and still other objects, which will be more clearly stressed later on, are achieved by providing an adjustable hooking device of the visor of an integral helmet for motorcyclists and the like for hooking the visor to a visor moving mechanism. The visor moving mechanism comprises means both for maintaining the visor, in its closed position, embedded in and flush with the cap, and for extracting the same from the embedding and for the opening upwards rotation, as well, as visor supporting and hooking means constituted by a shaped element, substantially a table of a substantially quadrangular form, which hooking device comprises according to the present invention:

- a visor having side guides, disposed on its internal face and translatably engaged with the flanks protruding from the opposite longitudinal sides of the table, as well as an opening so shaped as to house in its inside a tubular hooking element, translatably mounted within an eyelet obtained in the table;
- a slide, anchored on the internal face of the table for constraining the tubular visor hooking element translatable within the eyelet disposed in the table and having an eyelet or open cavity so shaped as to house in its inside a cylindrical bush coaxially anchored in the inside of the tubular hooking element, so as to be translatable in both directions and with a limited travel, together with the hooking element;
- a sheet-spring or the like, anchored to the slide integral with the table and so positioned as to close the open cavity of the slide and to exercise on the free end of the bush a pressure sufficient to maintain the hooking element entirely inserted in the visor cavity;
- A screw; engaged with a threading obtained in the bush, suitable to allow, when the visor is mounted, the stable locking of the bush with the slide and therefore the table, and after a partly unscrewing of the screw, the translation in both directions of the visor hooking element and the related bush, so as to allow the adjustment of the visor position with regard to the helmet and the subsequent stable mounting of the system through the tightening of the screw.

More particularly, the sheet-spring is sized to exercise a force on the hooking system to allow the disengagement of the tubular element of the visor hooking from the visor. This unhooking occurs by means of a pressure axially exercised, towards the inside of the helmet, on the element until the latter is disengaged from the visor aperture. This movement allows the visor to be disassembled without using any tool.

In the same way, the spring acting on the locking system, constituted by the hooking element and the bush, exerts enough force to bend the locking system towards the inside of the helmet during the translation of the visor on the table. This occurs until the visor aperture faces the hooking element, allowing the hooking element to translate towards the outside of the helmet. This hooking element engages the aperture and ensuring the locking of the visor.

BRIEF DESCRIPTION OF THE DRAWINGS

Other objects and features of the present invention will become apparent from the following detailed description considered in connection with the accompanying drawings, which disclose several embodiments of the present invention. It should be understood, however, that the drawings are designed for the purpose of illustration only and not as a definition of the limits of the invention.

In the drawings wherein similar reference characters denote similar elements throughout the several views.

DETAILED DESCRIPTION OF THE PREFERRED EMBODIMENT

Figure 1:
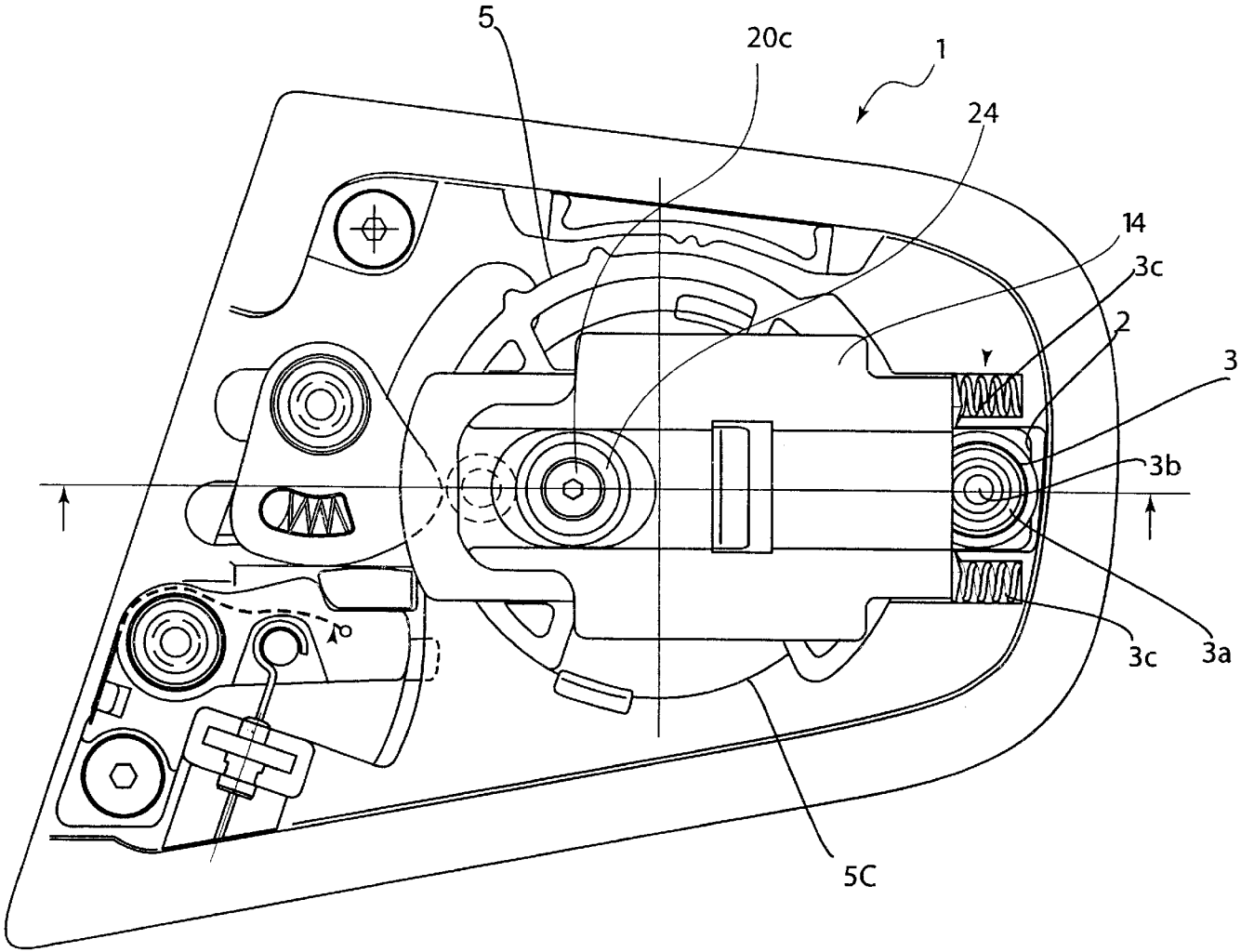
FIG. 1 shows a, front view of a mechanism of rotation of the visor object of U.S. Pat. No. 6,253,386 incorporated herein by reference which is, shown without the visor, to which the adjustable visor hooking device object of the present invention is applicable.

Referring in detail to the drawings FIG. 1 shows the device according to U.S. Pat. No. 6,253,386 B1 incorporated herein by reference. FIG. 1 shows base plate 1, an external slide 2 slidingly mounted in a rectangular seat centrally positioned with respect to the base plate 1. External slide 2 has, at one end, a sleeve 3 with an associated bush 3*a* that rotates about a rivet 3*b* emerging from external slide 2. External slide 2 is then disposed opposite pre-loaded springs 3*c*. Pre-loaded springs would maintain the external slide 2 always pushed towards the front part of the helmet, but an unlocking lever, not visible, allows to keep said slide back and the springs loaded. The device also includes a disk-like body 5 that rotates according to a set of prefixed angle shiftings. Body 5 is located in the middle of base 1 within a sleeve 5*a* and the related restraint central screw 5*b* on the internal face of base plate 1 by interposition of a washer 5*d* (See FIGS. 1, 2A, 2B). Rotary body 5 is responsible, when the visor is moved away from the helmet, for the rotation of the visor itself. More particularly, rotary body 5 has, as shown by the detail illustrated in FIGS. 3A and 3B a disk-like base 5*c* wherefrom two parallel flanks 6–6*a* emerge, within each of which two inclined guides 7–7*a* are disposed. In addition, within base plate 5*c* and flange 7*d* connecting the upper end of flanks 6 and 6*a,* there is a space suitable to allow the translation, in both directions, of a second slide 4, parallel to external slide 2.

Second or internal slide 4, translatable between raised flanks 6 and 6*a* of rotary body 5 and disposed above external slide 2, has on its end an arched recess or cam 4*a*. Cam 4*a* engages, joining the two slides, with sleeve 3 of external slide 2 (See FIGS. 2A and 2B) when external slide 2 and internal slide 4 are superimposed to one another and parallel to each other. For example, this occurs when the device is positioned to keep visor 9 in closed position, as in FIG. 2*a*.

The internal slide has two connecting rods 11, 11*a* pivoted at an end on slide 4 and, in correspondence of the other end, at table 14 of the device.

Figure 3A:
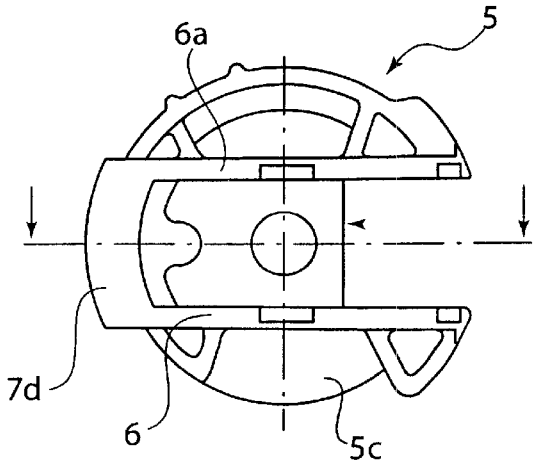
FIG. 3A shows a front view of a portion of the device shown in FIG. 1.
Figure 3B:
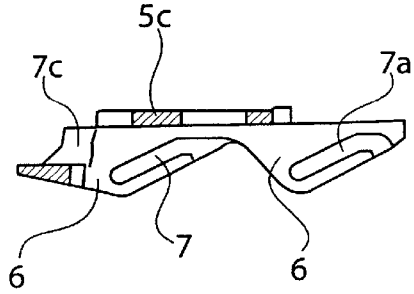
FIG. 3B shows a cross-sectional view of the device shown in FIG. 3A.

On each of flanks of rods 11–11*a,* is disposed a pin (not shown) that engages within inclined grooves 7–7*a* as shown in FIG. 3B. These grooves are slidingly disposed in two flanks 6–6*a* of rotary body 5.

Figure 2A:
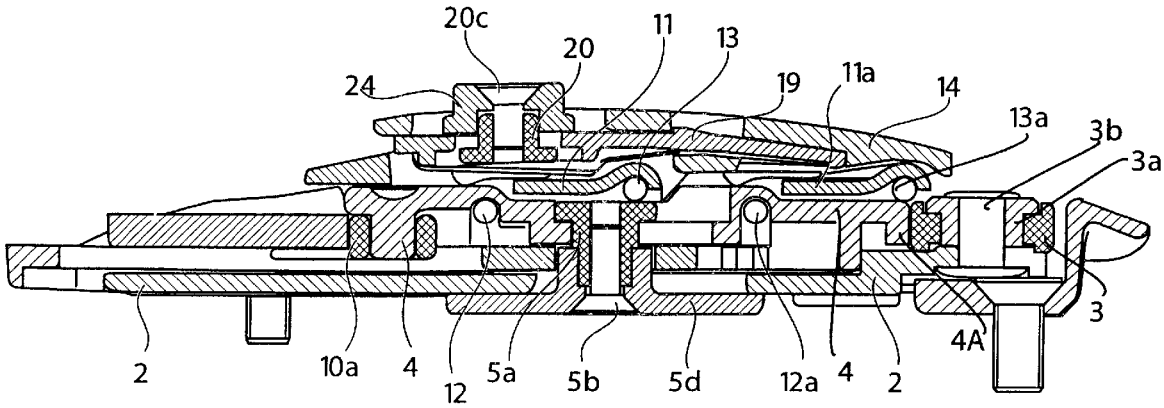
FIG. 2A shows a cross sectional view of the device according to FIG. 1 embedded in the helmet.
Figure 2B:
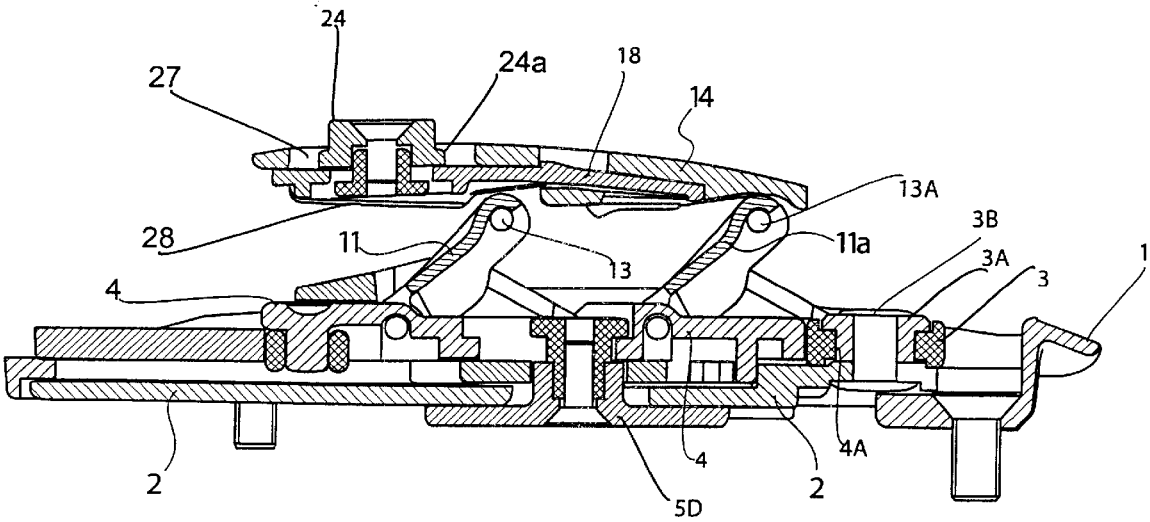
FIG. 2B shows a cross sectional view of the device according to FIG. 2 extending out from the helmet.

The hand-activation of the unlocking-lever (not shown) leads slide 2, under the action of springs 3C, and slide 4 integral with it, to translate towards the front part of the helmet, leading also the connecting rods 11, 11*a,* to raise with respect to slide 4 which passes from the flat position shown in FIG. 2A to a raised position inclined towards the outside shown in FIG. 2B.

This operation causes helmet visor 9, hooked to table 14, to come out from the entirely embedded closing position flush with the cap. In this manner, visor 9 gets on the outside of the cap, out of the embedding and ready to be rotated upwards.

In detail, the raising of connecting rods 11, 11A is made possible sliding along inclined guides, forming an obtuse angle with the plane of slide 4, of pins (not shown), protruding from the connecting rods 11, 11*a*. The inclined guides are in counter-slope with regard to the inclination of connecting rods 11, 11*a*.

The mechanism as described hereinabove and as shown in FIGS. 1, 2*a,* 2*b* is then completed by a release lever, by a recovery lever and other means to allow the stable opening of the visor in several intermediate positions as well as the recovery of the visor in its closed and perfectly aligned position with respect to the external surface of the helmet.

Figure 4:
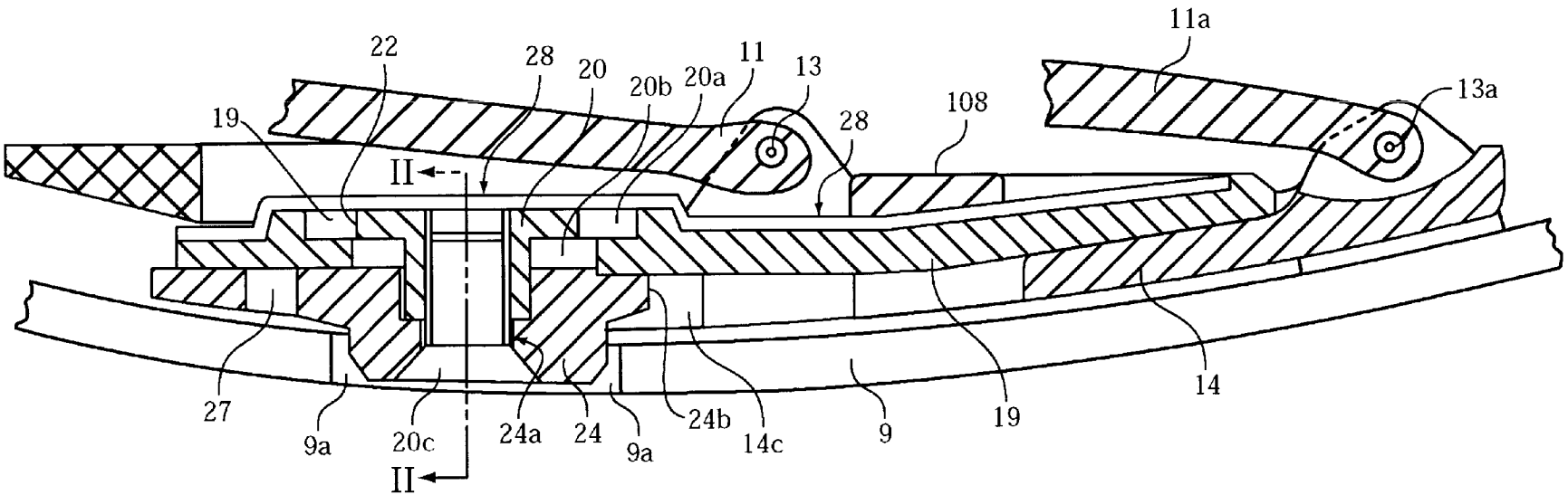
FIG. 4 shows, a cross-sectional view of the device according to the present application.
Figure 6:
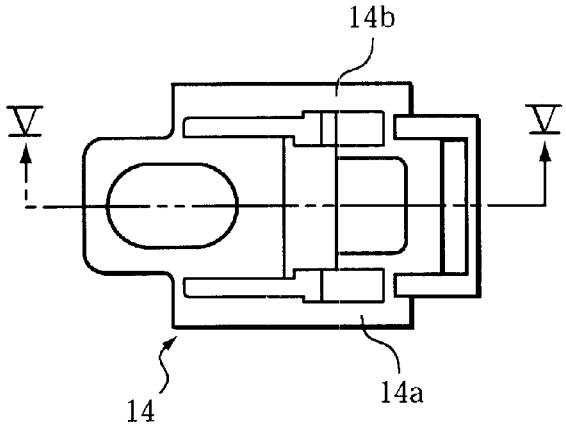
FIG. 6 shows a top view of a portion of the device shown in FIG. 2.
Figure 7:
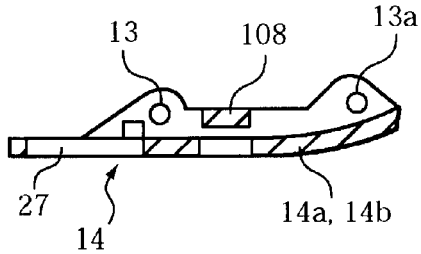
FIG. 7 shows a cross-sectional view of FIG. 6 taken along the line V—V.

Table 14 provides support for visor 9 protruding from the cap, as shown in better details in FIG. 4. Alternatively, the device may use a similar support provided by other like visor rotation mechanisms, even though they do not provide for a visor embedded in the helmet cap.

Therefore, the device according to the invention, illustrated in FIGS. 4–7, comprises a table 14 having a substantially rectangular shape, having opposite protruding sides or flanks 14*a*–14*b* (FIGS. 5–7) and with a wide eyelet or opening 14*c*. Table 14 is hinged on hinges 13–13*a* to connecting rods 11–11*a* of a visor rotation mechanism like the one shown in FIGS. 1, 2A, 2B.

Figure 5:
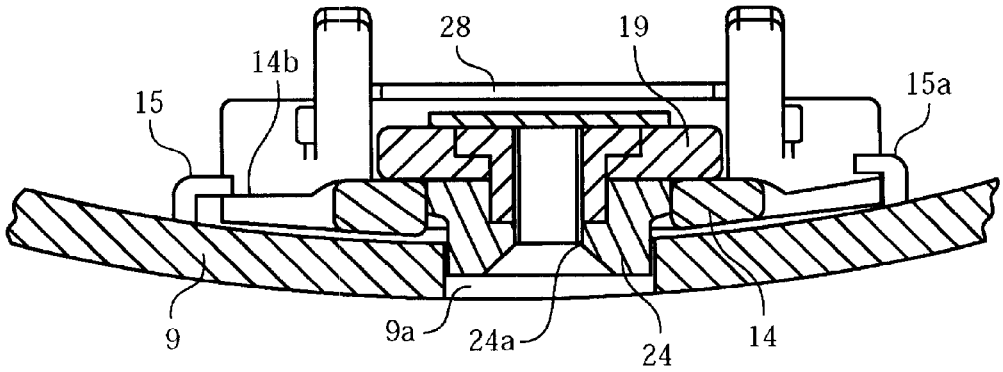
FIG. 5 shows a cross-sectional view of a portion of the device according to the present application.

On the external surface of table 14 shown in FIGS. 4 and 5, there is translatably mounted in both directions a conventional transparent visor 9, having an opening 9A. Essentially the external surface of table 14 is the surface that points towards the outside of the helmet when the device is mounted in the helmet. Visor 9 can be translated by using two opposite guides 15–15*a* shown in FIG. 5. Guides 15 and 15*a* are slidingly engaged against flanks 14*a*–14*b* of table 14. Visor 9 has two opposite guides 15–15*a,* positioned sideways to opening 9*a,* which may slide with both sides 14*a* 14*b* of table 14 to allow the translation of visor 9.

Referring to FIG. 5, visor 9 translates mainly perpendicularly to the sheet. The opening or hole 9*a* of visor 9 is sized to house in its inside, a cylindrical block 24 having an axial cavity 24A shown in FIGS. 4 and 5. Block 24 has an edge 24B, which allows it to freely translate within eyelet 14C disposed in table 14.

On the internal surface of table 14, i.e. the one that, upon the assembly of the device, faces the inside of the helmet, there is anchored in a stable manner a slide 19 having a first eyelet 20A in a position coaxial with eyelet 14C disposed in table 14, and also a second eyelet 20B positioned concentrically having a greater size with respect to the size of the first eyelet 20A. Eyelet 20B is open on the top.

During the assembly of the device, slide 19 is inserted and blocked thanks to special projections obtained on the same but not visible between the tie rod 108 and the internal surface of table 14. The particular anchoring of slide 19 blocks the one end of slide 19 to table 14, allowing the remaining free end of slide 19 to flex, in a direction substantially orthogonal to table 14. This allows the remaining free end of slide 19 to move away from the table 14 The remaining free end, is the end which, when the slide is inserted, results more distant from tie-rod 108.

The device also includes a bush 20 having a peripheral edge and coaxially anchored in the inside of the cylindrical block 24. which allows it to translate within eyelet 20B.

The cylindrical block 24 is fixed at its end on the outside of table 14 by a sheet-like spring 28. Flat spring 28, anchored to the opposite ends of slide 19 and placed between slide 19 and tie-rod 108—see FIG. 4—allows the spring-back of the free end of slide 19 towards table 14, if such end should be subject to flexing.

During the visor assembly operation, the hooking block 24, being integral with the end of slide 19 capable of flexing, can yield towards the inside of the helmet overcoming the strength of the flat spring 28. Block 24 is integral with the end of slide 19 and capable of flexing, as it is screwed by means of screw 20C to bush 20 opposite, with respect to slide 19, to said block 24. Flat spring 28 is anchored at its opposite ends to the hooking slide 19. The spring rests on the end, internal relative to the helmet, of bush 20 so as to impart stability to the assembly comprising block 24 and bush 20, integral with block 24. In addition this assembly is able to bend towards the inside of the helmet, until it brings the ends of block 24 flush with the external surface of table 14, by means of a pressure exercised on block 24. Bush 20 is threaded in the inside so as to house a flathead screw 20C as shown in FIG. 4, intended for locking the hooking element 24 against slide 19. This design results in the screw head being embedded in and flush with block 24 and therefore the visor 9 and also the cap, in the case of a mechanism having an embedded visor when it is in a closed position.

Two similarly structured hooking devices structured as shown in FIG. 4 are used for hooking the visor to both sides of the cap.

In practice, visor 9 is assembled on the hooking device of FIG. 4, by causing the visor to slide on table 14 because of guides 15 obtained on the visor (FIG. 4), which translatably couple with flanks 14*a*–14*b* of table 14.

During the visor assembly operation, hooking block 24 may yield towards the inside of the helmet, overcoming the strength of the sheet-like spring 28 as it is integral with the bush 20, which is directly in touch with the spring.

When visor 9 slides on table 14, the opening 9*a* of visor 9 faces the hooking block 24, the latter snaps towards the outside of the helmet, engaging opening 9*a* of the visor, ensuring its stable locking. At the start of the visor assembly stage, the hooking block 24 is mounted in an intermediate position with respect to its translation eyelet 14C on table 14 by tightening screw 20C. Next, by unscrewing screw 20C, it is possible and easy to cause the hooking block 24 to translate forwards and backwards with respect to slide 19 thanks to eyelet 20B wherein bush 20 is integral with the hooking block slides. Therefore, by causing the visor hooking block 24 to translate, it is possible, when the visor is mounted, to adjust the position of the visor with respect to the helmet. In addition, after the visor reaches the correct position, locking screw 20C can be tightened.

To carry out the disassembly of visor 9, hooking block 24 can be pressed towards the inside of the helmet, until spring 28, and particularly its free end,-is bent to such an extent as to allow the disengagement of the hooking block 24 of opening 14*a* of the visor. Now, by pushing the visor towards the front part of the helmet, it is possible to cause the visor to slide with respect to table 14, until its guides 15–15*a* (FIG. 5) are no longer coupled with flanks 14*a*–14*b* of the table.

As shown in FIG. 4, there is shown that tubular hooking element 24 that when pressed, changes the shape of hooking slide 19. Slide 19 is also pushed by spring 28 which changes its shape allowing for the release of visor 9.

Accordingly, while several embodiments of the present invention have been shown and described, it is to be understood that many changes and modifications may be made thereunto without departing from the spirit and scope of the invention as defined in the appended claims.

What is claimed is:

1. A golf club iron which includes a club face, a top flange, a bottom sole, a toe, and a heel, and said iron being of a first or primary color which is characterized by having more than three substantially equally spaced markers positioned laterally across the full width of the club from toe to heel and where they are visible to the club user to facilitate the lateral positioning of the ball relatively to the club face at address position, and wherein at least one of said lateral positioning markers is colored of a second or secondary color to distinguish from the primary color of the iron and to identify the proper lateral positioning of the ball relative to the club face at address by the club user.

2. The hooking device according to claim 1, wherein said sheet-spring is sized to exert a force on said hooking element and bush to allow the disengagement of said tubular hooking element of the visor from the visor by a pressure axially exerted towards an inside region of the helmet on said tubular element until it disengages from the opening of the visor allowing the visor to be disassembled without using tools.

3. The hooking device according to claim 1, wherein said sheet-spring is anchored to said slide and said sheet spring bends towards an inside region of said helmet until the opening of the visor faces said hooking element allowing said hooking element to translate towards an outside region of said helmet engaging said opening of the visor ensuring its stable locking.

4. The hooking device as in claim 1, wherein said hooking element has a flaring and wherein said screw is conical in shape to allow said screw to embed into said flaring of said hooking element when said screw is locked.

* * * * *

UNITED STATES PATENT AND TRADEMARK OFFICE

CERTIFICATE OF CORRECTION

PATENT NO. : 6,557,184 B2
DATED : May 6, 2003
INVENTOR(S) : Gaffurio

It is certified that error appears in the above-identified patent and that said Letters Patent is hereby corrected as shown below:

Column 6,
Line 47, claim 1 should read as follows:

1. A device for adjustably hooking a visor of an integral helmet for motorcyclists to a movement mechanism for opening and closing the visor, wherein the visor has at least one opening and wherein the visor can be maintained in its closed position, embedded in and flush with a cap, and extracted from the embedding, and then opened upwards via rotation, wherein the device comprises:

a) a series of side guides disposed on an internal face of the visor;

b) a table having a series of Longitudinal sides, said table having an eyelet and being coupled to the visor;

c) a series of flanks extending out from said longitudinal sides of said table;

d) a tubular hooking element disposed within said eyelet of said table and in the opening in the visor;

e) a slide anchored on an internal face of said table, for constraining said tubular visor hooking element translatable within an eyelet or open cavity thereof;

f) a cylindrical bush coaxially anchored on an inside region of said tubular hooking element so as to be translatable in two directions and with a limited travel together with said hooking element said bush being threaded;

g) a sheet spring anchored to said slide positioned to close said open cavity of said slike and to exercise a pressure on a free end of said cylindrical bush to maintain said hooking element entrely in the visor opening; and

UNITED STATES PATENT AND TRADEMARK OFFICE

CERTIFICATE OF CORRECTION

PATENT NO. : 6,557,184 B2
DATED : May 6, 2003
INVENTOR(S) : Gaffurio

It is certified that error appears in the above-identified patent and that said Letters Patent is hereby corrected as shown below:

Column 6 (cont'd), h) a screw, engaged with said threading in said bush, said screw for locking said bush with said slide and said table when the visor is mounted, wherein after partly unscrewing said screw, said screw allows a translation in both direction of said visor hooking element and said bush, to allow an adjustment of the visor position with regard to the helmet and a subsequent stable mounting of the visor through a tightening of said screw.

Signed and Sealed this

First Day of February, 2005

JON W. DUDAS
*Director of the United States Patent and Trademark Office*